US009900952B1

(12) United States Patent
Cao

(10) Patent No.: US 9,900,952 B1
(45) Date of Patent: Feb. 20, 2018

(54) POWER REGULATING CIRCUIT AND LIQUID CRYSTAL DISPLAY DEVICE

(71) Applicant: Shenzhen China Star Optoelectronics Technology Co., Ltd., Shenzhen, Guangdong (CN)

(72) Inventor: Dan Cao, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 174 days.

(21) Appl. No.: 15/032,614

(22) PCT Filed: Feb. 3, 2016

(86) PCT No.: PCT/CN2016/073243
§ 371 (c)(1),
(2) Date: Apr. 27, 2016

(87) PCT Pub. No.: WO2017/120995
PCT Pub. Date: Jul. 20, 2017

(30) Foreign Application Priority Data

Jan. 15, 2016 (CN) ..... 2016 1 0028074

(51) Int. Cl.
*H05B 33/08* (2006.01)
*G09G 3/34* (2006.01)

(52) U.S. Cl.
CPC ..... *H05B 33/0851* (2013.01); *H05B 33/0815* (2013.01)

(58) Field of Classification Search
CPC ..... H05B 33/08; H05B 33/0815; H05B 33/0851; H05B 33/0848; H05B 33/0833; H05B 37/02; G09G 3/34; G09G 3/3406; G09G 3/36
See application file for complete search history.

(56) References Cited

U.S. PATENT DOCUMENTS 8,159,419 B2 * 4/2012 Lee ..... G09G 3/14 313/463
2004/0208011 A1 * 10/2004 Horiuchi ..... G09G 3/30 362/458
2010/0259191 A1 * 10/2010 Ghanem ..... H05B 33/0851 315/297
2011/0089845 A1 * 4/2011 Keh ..... G09G 3/3406 315/209 R
2013/0221875 A1 * 8/2013 Liao ..... H05B 33/0851 315/307

* cited by examiner

*Primary Examiner* — Thai Pham
(74) *Attorney, Agent, or Firm* — Andrew C. Cheng

(57) ABSTRACT

The present invention provides a power regulating circuit and a liquid crystal display device. The light emitting unit is applied with a first supply voltage for emitting light, and the power regulating circuit comprises a brightness sensing unit, a power consumption detecting unit, a control chip and a voltage regulating unit, and the brightness sensing unit senses a brightness, and the power consumption detecting unit detects a power consumption, which is a first power consumption, and the control chip compares the first power consumption with a minimum power consumption of a current brightness of the light emitting unit, and as a difference of the first power consumption and the minimum power consumption is larger than a preset threshold value, the control chip controls the voltage regulating unit to decrease an amplitude of the first supply voltage and to increase a duty ratio of the first supply voltage.

18 Claims, 3 Drawing Sheets

POWER REGULATING CIRCUIT AND LIQUID CRYSTAL DISPLAY DEVICE

CROSS REFERENCE

This application claims the priority of Chinese Patent Application No. 201610028074.5, entitled "Power regulating circuit and liquid crystal display device", filed on Jan. 15, 2016, the disclosure of which is incorporated herein by reference in its entirety.

FIELD OF THE INVENTION

The present invention relates to a display field, and more particularly to a power regulating circuit and a liquid crystal display device.

BACKGROUND OF THE INVENTION

With the development of the display technology, the liquid crystal display panel possesses properties of small volume and light weight, low power consumption. Therefore, it has been favored by the users. The liquid crystal display device generally comprises the backlight module and the liquid crystal display panel. The backlight module is employed to provide the light for the liquid crystal display panel, and the liquid crystal display panel is employed to show information of words and images. The backlight module generally comprises a light emitting unit, and the light emitting unit receives the supply voltage to emit light. According to the actual requirement, the light emitting brightness of the light emitting unit will be adjusted. However, in prior art, even the light emitting brightness of the light emitting unit is adjusted to be the disclosed brightness, the power consumption of the light emitting unit remains to be larger. Thus, it makes the energy consumption of the liquid crystal display device higher.

SUMMARY OF THE INVENTION

The present invention provides a power regulating circuit, wherein the power regulating circuit is employed to adjust a power consumption of a light emitting unit, and the light emitting unit is applied with a first supply voltage for emitting light, and the power regulating circuit comprises a brightness sensing unit, a power consumption detecting unit, a control chip and a voltage regulating unit, and the brightness sensing unit is employed to sense a brightness as the light emitting unit emits light, and the power consumption detecting unit is employed to detect a power consumption, which is a first power consumption as the light emitting unit emits light, and the control chip is employed to compare the first power consumption with a minimum power consumption of a current brightness of the light emitting unit, and as a difference of the first power consumption and the minimum power consumption is larger than a preset threshold value, the control chip controls the voltage regulating unit to decrease an amplitude of the first supply voltage and to increase a duty ratio of the first supply voltage so that the light emitting unit remains the brightness unchanged and a difference value of a power consumption of the light emitting unit and the minimum power consumption is smaller than or equal to the preset threshold value, wherein after the amplitude and the duty ratio of the first supply voltage are adjusted and in condition that the brightness of the light emitting unit is unchanged, the power consumption of the light emitting unit is the second power consumption.

The power consumption detecting unit comprises a multiplying unit, and the multiplying unit comprises a first multiplying input end, a second multiplying input end, a third multiplying input end and a multiplying output end, and the first multiplying input end is grounded through a first resistor, and the first multiplying input end receives a first voltage, and the second multiplying input end receives a multiplying factor, and the third multiplying input end is employed to receives an original supply voltage, and the multiplying unit obtains the first power consumption according to the first voltage, the first resistor, the original supply voltage and the multiplying factor and outputs the same through the multiplying output end.

The power regulating circuit further comprises a photocoupler, and the photocoupler comprises a first coupling input end, a second coupling input end, a first coupling output end and a second coupling output end, and the first coupling input end receives the original supply voltage, and the second coupling input end is coupled to the light emitting unit, and the first coupling output end receives the original supply voltage through the first resistor, and the second coupling output end is grounded through a second resistor.

The control chip comprises a brightness signal receiving end, a power consumption signal receiving end, a first control signal output end, a second control signal output end, and the voltage regulating unit comprises a voltage amplitude adjusting unit and a voltage duty ratio adjusting unit, and the brightness signal receiving end is electrically coupled to the brightness sensing unit, and is employed to receive a brightness signal representing the brightness as the light emitting unit emits light, and the power consumption signal receiving end is electrically coupled to power consumption detecting unit, and is employed to receive the first power consumption, and the control chips sends a first control signal and a second control signal according to the brightness signal and the first power consumption and outputs the same respectively through first control signal output end and the second control signal output end, and the voltage amplitude adjusting unit is electrically coupled to the first control signal output end, and reduces the amplitude of the first supply voltage under control of the first control signal, and the voltage duty ratio adjusting unit is electrically coupled to the second control signal output end, and increases the duty ratio of the first supply voltage under control of the second control signal.

The voltage amplitude adjusting unit comprises a selector, a control register and a third resistor, and the first control signal output end comprises a first sub control signal output end, a second sub control signal output end, a third sub control signal output end and a fourth sub control signal output end, and the control chip is further employed to generate a resister control signal to be outputted through the fourth sub control signal output end, and the selector comprises a first select signal input end, a second select signal input end, a third select signal input end, a first signal end, a second signal end, a third signal end, a fourth signal, a fifth signal end, a sixth signal end, a seven signal end, an eighth signal end and a select signal output end, and wherein the first signal end to the eighth signal end are respectively supplied with various reference voltages, and the first select signal input end is electrically coupled to the first sub control signal output end, and the second select signal input end is electrically coupled to the second sub control signal output end, and the third select signal input end is electrically coupled to the third sub control signal output end, and the first select signal input end, the second select signal input end and the third select signal input end are employed to receive the first control signal, and the selector selects one reference voltage on the first signal end to the eighth signal end according to the first control signal, and outputs the same through the select signal output end, and the control register comprises a first end, a second end and a first output end, and the first end is electrically coupled to the fourth sub control signal output end to receive the register control signal, and the second end is electrically coupled to the select signal output end to receive the corresponding reference voltage, and the first output end is coupled to the third resistor and grounded, and a node between the first output end and the third resistor is employed to be an output end of the voltage amplitude adjusting unit, and the control register obtains a voltage amplitude adjusting signal according to the corresponding reference voltage and the register control signal, and outputs the same through the node between the first output end and the third resistor, and the voltage amplitude adjusting signal is employed to reduce the amplitude of the first supply voltage.

As the first select signal input end, the second select signal input end and the third select signal input end sequentially receive the first control signal of 000, the selector selects the reference voltage of the first signal end and outputs the same through the select signal output end; as the first select signal input end, the second select signal input end and the third select signal input end sequentially receive the first control signal of 001, the selector selects the reference voltage of the second signal end and outputs the same through the select signal output end;

as the first select signal input end, the second select signal input end and the third select signal input end sequentially receive the first control signal of 010, the selector selects the reference voltage of the third signal end and outputs the same through the select signal output end; as the first select signal input end, the second select signal input end and the third select signal input end sequentially receive the first control signal of 011, the selector selects the reference voltage of the fourth signal end and outputs the same through the select signal output end; as the first select signal input end, the second select signal input end and the third select signal input end sequentially receive the first control signal of 100, the selector selects the reference voltage of the fifth signal end and outputs the same through the select signal output end; as the first select signal input end, the second select signal input end and the third select signal input end sequentially receive the first control signal of 101, the selector selects the reference voltage of the sixth signal end and outputs the same through the select signal output end; as the first select signal input end, the second select signal input end and the third select signal input end sequentially receive the first control signal of 110, the selector selects the reference voltage of the seventh signal end and outputs the same through the select signal output end; as the first select signal input end, the second select signal input end and the third select signal input end sequentially receive the first control signal of 111, the selector selects the reference voltage of the eighth signal end and outputs the same through the select signal output end.

The power regulating circuit further comprises a first thin film transistor, and the first thin film transistor comprises a first gate, a first source and a first drain, and an input end of the voltage duty ratio regulating unit is electrically coupled to the second control signal output end to receive the second control signal, and an output end of the voltage duty ratio regulating unit is electrically coupled to the first gate, and the first source is electrically coupled to a node between the first output end and the third resistor, and the first drain is electrically coupled to the light emitting unit.

The light emitting unit is a light emitting diode.

The brightness sensing unit is located adjacent to the light emitting unit.

In comparison with prior art, the brightness sensing unit in the power regulating circuit of the present invention senses a brightness as the light emitting unit emits light, and the power consumption detecting unit detects a power consumption, which is a first power consumption as the light emitting unit emits light, and as the first power consumption is compared with a minimum power consumption of a current brightness of the light emitting unit, and a difference of the first power consumption and the minimum power consumption is larger than a preset threshold value, the control chip controls the voltage regulating unit to decrease an amplitude of the first supply voltage and to increase a duty ratio of the first supply voltage so that the light emitting unit remains the brightness unchanged and a difference value of a power consumption of the light emitting unit and the minimum power consumption is smaller than or equal to the preset threshold value. After the amplitude and the duty ratio of the first supply voltage are adjusted and in condition that the brightness of the light emitting unit is unchanged, the power consumption of the light emitting unit is the second power consumption. Accordingly, the power regulating circuit of the present invention can reduce the power consumption of the light emitting unit in condition that the brightness of the light emitting unit is unchanged, and thus to decrease the energy consumption of the light emitting unit.

The present invention further provides a liquid crystal display device. The liquid crystal display device comprises the power regulating circuit of any one of the respective aforesaid embodiments.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

Figure 1:
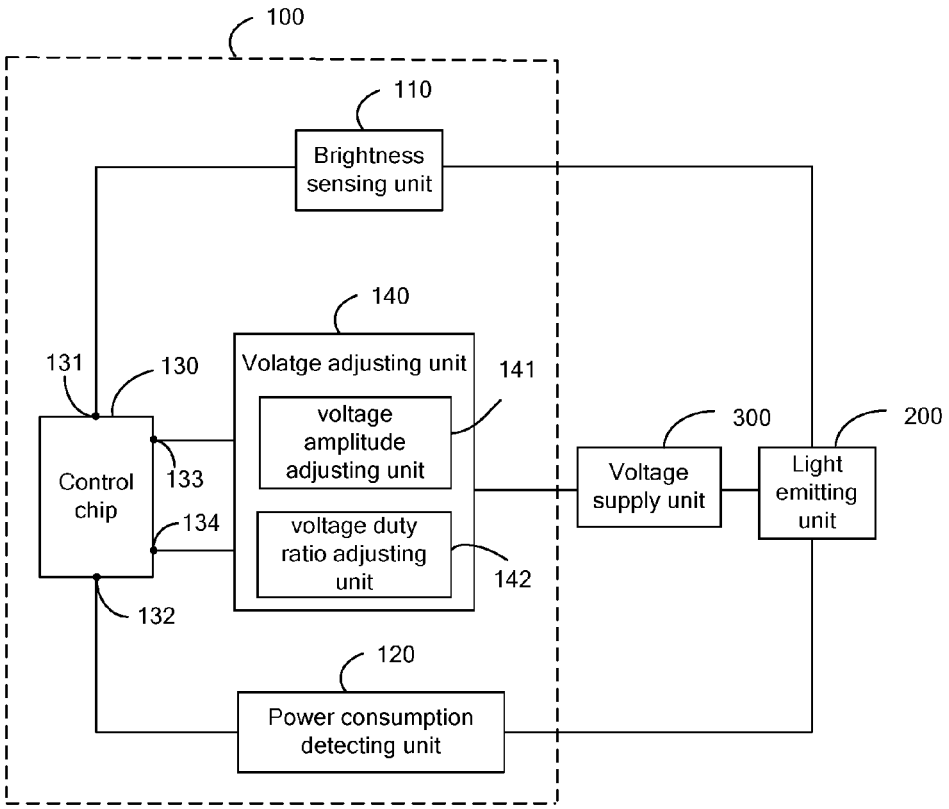
FIG. 1 is a circuit structure diagram of a power regulating circuit according to one preferred embodiment of the present invention.
Figure 2:
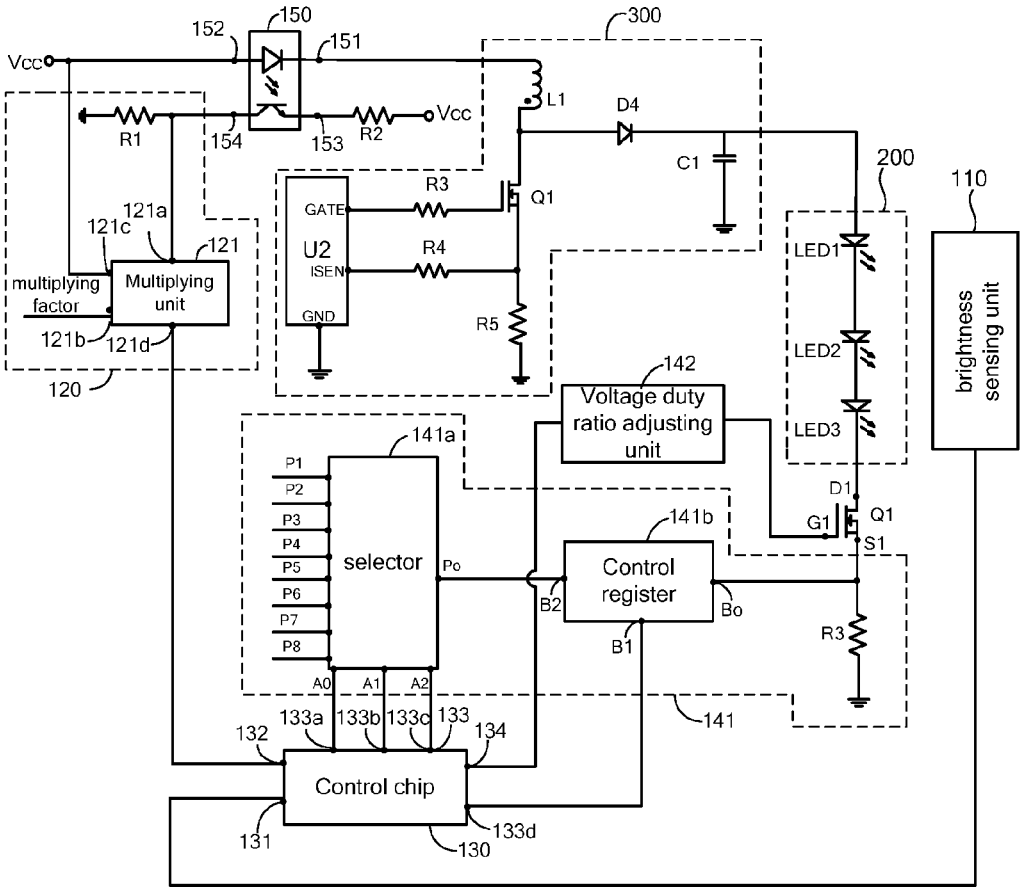
FIG. 2 is a specific circuit diagram of a power circuit according to one preferred embodiment of the present invention.

Please refer to FIG. 1 and FIG. 2. FIG. 1 is a circuit structure diagram of a power regulating circuit according to one preferred embodiment of the present invention; FIG. 2 is a specific circuit diagram of a power circuit according to one preferred embodiment of the present invention. The power regulating circuit 100 is employed to adjust a power consumption of a light emitting unit 200. The light emitting unit 200 is applied with a first supply voltage for emitting light, and the power regulating circuit 100 comprises a brightness sensing unit 110, a power consumption detecting unit 120, a control chip 130 and a voltage regulating unit 140. The brightness sensing unit 110 is employed to sense a brightness as the light emitting unit 200 emits light, and the power consumption detecting unit 120 is employed to detect a power consumption, which is a first power consumption as the light emitting unit 200 emits light, and the control chip 130 is employed to compare the first power consumption with a minimum power consumption of a current brightness of the light emitting unit 200, and as a difference of the first power consumption and the minimum power consumption is larger than a preset threshold value, the control chip 130 controls the voltage regulating unit 140 to decrease an amplitude of the first supply voltage and to increase a duty ratio of the first supply voltage so that the light emitting unit 200 remains the brightness unchanged and a difference value of a power consumption of the light emitting unit 200 and the minimum power consumption is smaller than or equal to the preset threshold value, wherein after the amplitude and the duty ratio of the first supply voltage are adjusted and in condition that the brightness of the light emitting unit 200 is unchanged, the power consumption of the light emitting unit 200 is the second power consumption. The first supply voltage is generated by a voltage supply unit 300. Preferably, the brightness sensing unit 110 is located adjacent to the light emitting unit 200 to sense the brightness as the light emitting unit 200 emits light more accurately.

The power consumption detecting unit 120 comprises a multiplying unit 121, and the multiplying unit 121 comprises a first multiplying input end 121*a*, a second multiplying input end 121*b*, a third multiplying input end 121*c* and a multiplying output end 121*d*. The first multiplying input end 121*a* is grounded through a first resistor R1, and the first multiplying input end 121*a* receives a first voltage VA. The second multiplying input end 121*b* receives a multiplying factor, and the third multiplying input end 121*c* is employed to receives an original supply voltage, and the multiplying unit 121 obtains the first power consumption according to the first voltage, the first resistor R1, the original supply voltage and the multiplying factor and outputs the same through the multiplying output end 121*d*.

The power regulating circuit 100 further comprises a photocoupler 150, and the photocoupler 150 comprises a first coupling input end 151, a second coupling input end 152, a first coupling output end 153 and a second coupling output end 154. The first coupling input end 151 receives the original supply voltage, and the second coupling input end 152 is coupled to the light emitting unit 200, and the first coupling output end 153 receives the original supply voltage through the first resistor R1, and the second coupling output end 154 is grounded through a second resistor R2.

In this embodiment, the current transmission of the photocoupler 150 is B, then, the input current of the photocoupler 150 is Ii=VA/(R1*B), and the original voltage received by the photocoupler 150 is marked as Vcc, and then, the first power consumption is Vcc*VA/(R1*B), and thus, the multiplying factor of the multiplying unit 121 is equal to 1/(R1*B).

The control chip 130 comprises a brightness signal receiving end 131, a power consumption signal receiving end 132, a first control signal output end 133 and a second control signal output end 134. Correspondingly, the voltage regulating unit 140 comprises a voltage amplitude adjusting unit 141 and a voltage duty ratio adjusting unit 142. The brightness signal receiving end 131 is electrically coupled to the brightness sensing unit 110, and is employed to receive a brightness signal representing the brightness as the light emitting unit 200 emits light, and the power consumption signal receiving end 132 is electrically coupled to power consumption detecting unit 120, and is employed to receive the first power consumption. The control chips 130 sends a first control signal and a second control signal according to the brightness signal and the first power consumption and outputs the same respectively through first control signal output end 133 and the second control signal output end 134. In other words, the first control signal is outputted through the first control signal output end 133, and the second control signal is outputted through the second control signal output end 134. The voltage amplitude adjusting unit 141 is electrically coupled to the first control signal output end 133, and reduces the amplitude of the first supply voltage under control of the first control signal. The voltage duty ratio adjusting unit 142 is electrically coupled to the second control signal output end 134, and increases the duty ratio of the first supply voltage under control of the second control signal.

The voltage amplitude adjusting unit 141 comprises a selector 141*a*, a control register 141*b* and a third resistor R3. In this embodiment, the first control signal output end 133 comprises a first sub control signal output end 133*a*, a second sub control signal output end 133*b*, a third sub control signal output end 133*c* and a fourth sub control signal output end 133*d*. The control chip 130 is further employed to generate a resister control signal to be outputted through the fourth sub control signal output end 133*d*. The selector 141*a* comprises a first select signal input end A0, a second select signal input end A1, a third select signal input end A2, a first signal end P1, a second signal end P2, a third signal end P3, a fourth signal P4, a fifth signal end P5, a sixth signal end P6, a seven signal end P7, an eighth signal end P8 and a select signal output end Po. The first signal end P1 to the eighth signal end P8 are respectively supplied with various reference voltages. In this embodiment, the first signal end P1 is applied with the first reference voltage Vref1, and the second signal end P2 is applied with the second reference voltage Vref2, and the third signal end P3 is applied with the third reference voltage Vref3, and the fourth signal P4 is applied with the fourth reference voltage Vref4, and the fifth signal end P5 is applied with the fifth reference voltage Vref5, and the sixth signal end P6 is applied with the sixth reference voltage Vref6, and the seven signal end P7 is applied with the seventh reference voltage Vref7, and the eighth signal end P8 is applied with the eighth reference voltage Vref8. The first select signal input end A0 is electrically coupled to the first sub control signal output end 133*a*, and the second select signal input end A1 is electrically coupled to the second sub control signal output end 133*b*, and the third select signal input end A2 is electrically coupled to the third sub control signal output end 133*c*, and the first select signal input end A0, the second select signal input end A1 and the third select signal input end A2 are employed to receive the first control signal. The selector 141*a* selects one reference voltage on the first signal end P1 to the eighth signal end P8 according to the first control signal, and outputs the same through the select signal output end Po. The control register 141*b* comprises a first end B1, a second end B2 and a first output end Bo, and the first end B1 is electrically coupled to the fourth sub control signal output end 133*d* to receive the register control signal, and the second end B2 is electrically coupled to the select signal output end Po to receive the corresponding reference voltage, and the first output end Bo is coupled to the third resistor R3 and grounded, and a node between the first output end Bo and the third resistor R3 is employed to be an output end of the voltage amplitude adjusting unit 141. The control register 141*b* obtains a voltage amplitude adjusting signal according to the corresponding reference voltage and the register control signal, and outputs the same through the node between the first output end Bo and the third resistor R3, and the voltage amplitude adjusting signal is employed to reduce the amplitude of the first supply voltage. In this embodiment, the first reference voltage Vref1, the second reference voltage Vref2, the third reference voltage Vref3, the fourth reference voltage Vref4, the fifth reference voltage Vref5, the sixth reference voltage Vref6, the seventh reference voltage Vref7 and the eighth reference voltage Vref8 are different from one another. In one embodiment, the voltage values of the first reference voltage Vref1, the second reference voltage Vref2, the third reference voltage Vref3, the fourth reference voltage Vref4, the fifth reference voltage Vref5, the sixth reference voltage Vref6, the seventh reference voltage Vref7 and the eighth reference voltage Vref8 decrease in turn from the first reference voltage Vref1 to the eighth reference voltage Vref8; in another embodiment, the voltage values of the first reference voltage Vref1, the second reference voltage Vref2, the third reference voltage Vref3, the fourth reference voltage Vref4, the fifth reference voltage Vref5, the sixth reference voltage Vref6, the seventh reference voltage Vref7 and the eighth reference voltage Vref8 increase in turn from the first reference voltage Vref1 to the eighth reference voltage Vref8.

As the first select signal input end A0, the second select signal input end A1 and the third select signal input end A2 sequentially receive the first control signal of 000, the selector 141*a* selects the reference voltage of the first signal end P1 and outputs the same through the select signal output end Po; as the first select signal input end A0, the second select signal input end A1 and the third select signal input end A2 sequentially receive the first control signal of 001, the selector 141*a* selects the reference voltage of the second signal end P2 and outputs the same through the select signal output end Po; as the first select signal input end A0, the second select signal input end A1 and the third select signal input end A2 sequentially receive the first control signal of 010, the selector 141*a* selects the reference voltage of the third signal end P3 and outputs the same through the select signal output end Po; as the first select signal input end A0, the second select signal input end A1 and the third select signal input end A2 sequentially receive the first control signal of 011, the selector 141*a* selects the reference voltage of the fourth signal end P4 and outputs the same through the select signal output end Po; as the first select signal input end A0, the second select signal input end A1 and the third select signal input end A2 sequentially receive the first control signal of 100, the selector 141*a* selects the reference voltage of the fifth signal end P5 and outputs the same through the select signal output end Po; as the first select signal input end A0, the second select signal input end A1 and the third select signal input end A2 sequentially receive the first control signal of 101, the selector 141*a* selects the reference voltage of the sixth signal end P6 and outputs the same through the select signal output end Po; as the first select signal input end A0, the second select signal input end A1 and the third select signal input end A2 sequentially receive the first control signal of 110, the selector 141*a* selects the reference voltage of the seventh signal end P7 and outputs the same through the select signal output end Po; as the first select signal input end A0, the second select signal input end A1 and the third select signal input end A2 sequentially receive the first control signal of 111, the selector 141*a* selects the reference voltage of the eighth signal end P8 and outputs the same through the select signal output end Po.

The power regulating circuit 100 further comprises a first thin film transistor Q1, and the first thin film transistor Q1 comprises a first gate G1, a first source S1 and a first drain D1. An input end of the voltage duty ratio regulating unit 142 is electrically coupled to the second control signal output end 134 to receive the second control signal, and an output end of the voltage duty ratio regulating unit 142 is electrically coupled to the first gate G1, and the first source S1 is electrically coupled to a node between the first output end Bo and the third resistor R3, and the first drain D1 is electrically coupled to the light emitting unit 200.

In this embodiment, the light emitting unit 200 is a light emitting diode. The light emitting diode comprises a positive electrode and a negative electrode. The first drain D1 is electrically coupled to the negative electrode of the light emitting unit 200. In FIG. 2, the amount of the shown light emitting units 200 is three, which respectively are LED1, LED2 and LED3. The LED1, the LED2 and the LED3 are coupled in series.

In comparison with prior art, the brightness sensing unit 110 in the power regulating circuit 100 of the present invention senses a brightness as the light emitting unit 200 emits light, and the power consumption detecting unit 120 detects a power consumption, which is a first power consumption as the light emitting unit emits light, and as the first power consumption is compared with a minimum power consumption of a current brightness of the light emitting unit 200, and a difference of the first power consumption and the minimum power consumption is larger than a preset threshold value, the control chip 130 controls the voltage regulating unit 140 to decrease an amplitude of the first supply voltage and to increase a duty ratio of the first supply voltage so that the light emitting unit 200 remains the brightness unchanged and a difference value of a power consumption of the light emitting unit 200 and the minimum power consumption is smaller than or equal to the preset threshold value. After the amplitude and the duty ratio of the first supply voltage are adjusted and in condition that the brightness of the light emitting unit 200 is unchanged, the power consumption of the light emitting unit 200 is the second power consumption. Accordingly, the power regulating circuit 100 of the present invention can reduce the power consumption of the light emitting unit 200 in condition that the brightness of the light emitting unit 200 is unchanged, and thus to decrease the energy consumption of the light emitting unit 200.

Figure 3:
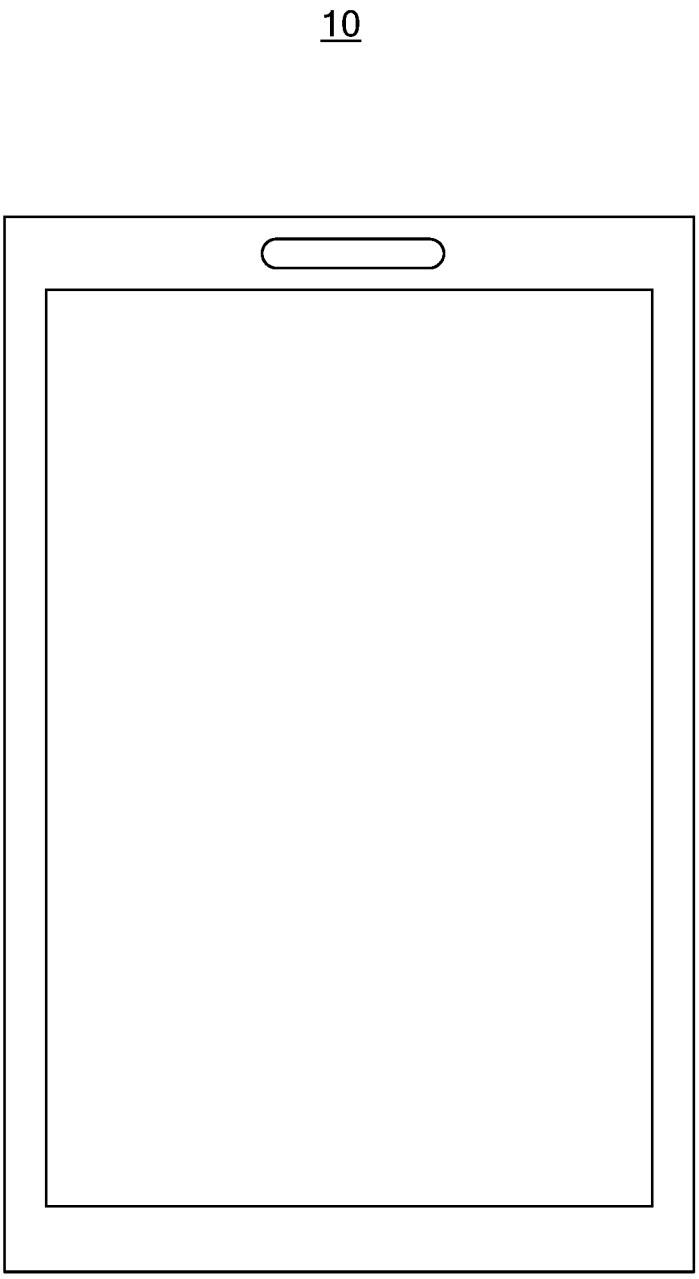
FIG. 3 is a structural diagram of a preferred embodiment according to a liquid crystal display device of the present invention.

The present invention further provides a liquid crystal display device 10. Please refer to FIG. 3. FIG. 3 is a structure diagram of a liquid crystal display device according to one preferred embodiment of the present invention. The liquid crystal display device 10 comprises the aforesaid power regulating circuit 100. The repeated description is omitted here. In this embodiment, the liquid crystal display device 10 comprises the smart phone, the mobile internet device (MID), the electronic book, the tablet, the Play Station Portable (PSP) or Personal Digital Assistant (PDA) but not limited thereto. The liquid crystal display device 10 also can be a liquid crystal display panel or others.

Above are embodiments of the present invention, which does not limit the scope of the present invention. Any modifications, equivalent replacements or improvements within the spirit and principles of the embodiment described above should be covered by the protected scope of the invention.

What is claimed is:

1. A power regulating circuit, wherein the power regulating circuit is employed to adjust a power consumption of a light emitting unit, and the light emitting unit is applied with a first supply voltage for emitting light, and the power regulating circuit comprises a brightness sensing unit, a power consumption detecting unit, a control chip and a voltage regulating unit, and the brightness sensing unit is employed to sense a brightness as the light emitting unit emits light, and the power consumption detecting unit is employed to detect a power consumption, which is a first power consumption as the light emitting unit emits light, and the control chip is employed to compare the first power consumption with a minimum power consumption of a current brightness of the light emitting unit, and as a difference of the first power consumption and the minimum power consumption is larger than a preset threshold value, the control chip controls the voltage regulating unit to decrease an amplitude of the first supply voltage and to increase a duty ratio of the first supply voltage so that the light emitting unit remains the brightness unchanged and a difference value of a power consumption of the light emitting unit and the minimum power consumption is smaller than or equal to the preset threshold value, wherein after the amplitude and the duty ratio of the first supply voltage are adjusted and in condition that the brightness of the light emitting unit is unchanged, the power consumption of the light emitting unit is the second power consumption.

2. The power regulating circuit according to claim 1, wherein the power consumption detecting unit comprises a multiplying unit, and the multiplying unit comprises a first multiplying input end, a second multiplying input end, a third multiplying input end and a multiplying output end, and the first multiplying input end is grounded through a first resistor, and the first multiplying input end receives a first voltage, and the second multiplying input end receives a multiplying factor, and the third multiplying input end is employed to receives an original supply voltage, and the multiplying unit obtains the first power consumption according to the first voltage, the first resistor, the original supply voltage and the multiplying factor and outputs the same through the multiplying output end.

3. The power regulating circuit according to claim 2, wherein the power regulating circuit further comprises a photocoupler, and the photocoupler comprises a first coupling input end, a second coupling input end, a first coupling output end and a second coupling output end, and the first coupling input end receives the original supply voltage, and the second coupling input end is coupled to the light emitting unit, and the first coupling output end receives the original supply voltage through the first resistor, and the second coupling output end is grounded through a second resistor.

4. The power regulating circuit according to claim 1, wherein the control chip comprises a brightness signal receiving end, a power consumption signal receiving end, a first control signal output end, a second control signal output end, and the voltage regulating unit comprises a voltage amplitude adjusting unit and a voltage duty ratio adjusting unit, and the brightness signal receiving end is electrically coupled to the brightness sensing unit, and is employed to receive a brightness signal representing the brightness as the light emitting unit emits light, and the power consumption signal receiving end is electrically coupled to power consumption detecting unit, and is employed to receive the first power consumption, and the control chips sends a first control signal and a second control signal according to the brightness signal and the first power consumption and outputs the same respectively through first control signal output end and the second control signal output end, and the voltage amplitude adjusting unit is electrically coupled to the first control signal output end, and reduces the amplitude of the first supply voltage under control of the first control signal, and the voltage duty ratio adjusting unit is electrically coupled to the second control signal output end, and increases the duty ratio of the first supply voltage under control of the second control signal.

5. The power regulating circuit according to claim 4, wherein the voltage amplitude adjusting unit comprises a selector, a control register and a third resistor, and the first control signal output end comprises a first sub control signal output end, a second sub control signal output end, a third sub control signal output end and a fourth sub control signal output end, and the control chip is further employed to generate a resister control signal to be outputted through the fourth sub control signal output end, and the selector comprises a first select signal input end, a second select signal input end, a third select signal input end, a first signal end, a second signal end, a third signal end, a fourth signal, a fifth signal end, a sixth signal end, a seven signal end, an eighth signal end and a select signal output end, and wherein the first signal end to the eighth signal end are respectively supplied with various reference voltages, and the first select signal input end is electrically coupled to the first sub control signal output end, and the second select signal input end is electrically coupled to the second sub control signal output end, and the third select signal input end is electrically coupled to the third sub control signal output end, and the first select signal input end, the second select signal input end and the third select signal input end are employed to receive the first control signal, and the selector selects one reference voltage on the first signal end to the eighth signal end according to the first control signal, and outputs the same through the select signal output end, and the control register comprises a first end, a second end and a first output end, and the first end is electrically coupled to the fourth sub control signal output end to receive the register control signal, and the second end is electrically coupled to the select signal output end to receive the corresponding reference voltage, and the first output end is coupled to the third resistor and grounded, and a node between the first output end and the third resistor is employed to be an output end of the voltage amplitude adjusting unit, and the control register obtains a voltage amplitude adjusting signal according to the corresponding reference voltage and the register control signal, and outputs the same through the node between the first output end and the third resistor, and the voltage amplitude adjusting signal is employed to reduce the amplitude of the first supply voltage.

6. The power regulating circuit according to claim 5, wherein as the first select signal input end, the second select signal input end and the third select signal input end sequentially receive the first control signal of 000, the selector selects the reference voltage of the first signal end and outputs the same through the select signal output end; as the first select signal input end, the second select signal input end and the third select signal input end sequentially receive the first control signal of 001, the selector selects the reference voltage of the second signal end and outputs the same through the select signal output end; as the first select signal input end, the second select signal input end and the third select signal input end sequentially receive the first control signal of 010, the selector selects the reference voltage of the third signal end and outputs the same through the select signal output end; as the first select signal input end, the second select signal input end and the third select signal input end sequentially receive the first control signal of 011, the selector selects the reference voltage of the fourth signal end and outputs the same through the select signal output end; as the first select signal input end, the second select signal input end and the third select signal input end sequentially receive the first control signal of 100, the selector selects the reference voltage of the fifth signal end and outputs the same through the select signal output end; as the first select signal input end, the second select signal input end and the third select signal input end sequentially receive the first control signal of 101, the selector selects the reference voltage of the sixth signal end and outputs the same through the select signal output end; as the first select signal input end, the second select signal input end and the third select signal input end sequentially receive the first control signal of 110, the selector selects the reference voltage of the seventh signal end and outputs the same through the select signal output end; as the first select signal input end, the second select signal input end and the third select signal input end sequentially receive the first control signal of 111, the selector selects the reference voltage of the eighth signal end and outputs the same through the select signal output end.

7. The power regulating circuit according to claim 5, wherein the power regulating circuit further comprises a first thin film transistor, and the first thin film transistor comprises a first gate, a first source and a first drain, and an input end of the voltage duty ratio regulating unit is electrically coupled to the second control signal output end to receive the second control signal, and an output end of the voltage duty ratio regulating unit is electrically coupled to the first gate, and the first source is electrically coupled to a node between the first output end and the third resistor, and the first drain is electrically coupled to the light emitting unit.

8. The power regulating circuit according to claim 1, wherein the light emitting unit is a light emitting diode.

9. The power regulating circuit according to claim 1, wherein the brightness sensing unit is located adjacent to the light emitting unit.

10. A liquid crystal display device, wherein the liquid crystal display device comprises a power regulating circuit, and the power regulating circuit is employed to adjust a power consumption of a light emitting unit, and the light emitting unit is applied with a first supply voltage for emitting light, and the power regulating circuit comprises a brightness sensing unit, a power consumption detecting unit, a control chip and a voltage regulating unit, and the brightness sensing unit is employed to sense a brightness as the light emitting unit emits light, and the power consumption detecting unit is employed to detect a power consumption, which is a first power consumption as the light emitting unit emits light, and the control chip is employed to compare the first power consumption with a minimum power consumption of a current brightness of the light emitting unit, and as a difference of the first power consumption and the minimum power consumption is larger than a preset threshold value, the control chip controls the voltage regulating unit to decrease an amplitude of the first supply voltage and to increase a duty ratio of the first supply voltage so that the light emitting unit remains the brightness unchanged and a difference value of a power consumption of the light emitting unit and the minimum power consumption is smaller than or equal to the preset threshold value, wherein after the amplitude and the duty ratio of the first supply voltage are adjusted and in condition that the brightness of the light emitting unit is unchanged, the power consumption of the light emitting unit is the second power consumption.

11. The liquid crystal display device according to claim 10, wherein the power consumption detecting unit comprises a multiplying unit, and the multiplying unit comprises a first multiplying input end, a second multiplying input end, a third multiplying input end and a multiplying output end, and the first multiplying input end is grounded through a first resistor, and the first multiplying input end receives a first voltage, and the second multiplying input end receives a multiplying factor, and the third multiplying input end is employed to receives an original supply voltage, and the multiplying unit obtains the first power consumption according to the first voltage, the first resistor, the original supply voltage and the multiplying factor and outputs the same through the multiplying output end.

12. The liquid crystal display device according to claim 11, wherein the power regulating circuit further comprises a photocoupler, and the photocoupler comprises a first coupling input end, a second coupling input end, a first coupling output end and a second coupling output end, and the first coupling input end receives the original supply voltage, and the second coupling input end is coupled to the light emitting unit, and the first coupling output end receives the original supply voltage through the first resistor, and the second coupling output end is grounded through a second resistor.

13. The liquid crystal display device according to claim 10, wherein the control chip comprises a brightness signal receiving end, a power consumption signal receiving end, a first control signal output end, a second control signal output end, and the voltage regulating unit comprises a voltage amplitude adjusting unit and a voltage duty ratio adjusting unit, and the brightness signal receiving end is electrically coupled to the brightness sensing unit, and is employed to receive a brightness signal representing the brightness as the light emitting unit emits light, and the power consumption signal receiving end is electrically coupled to power consumption detecting unit, and is employed to receive the first power consumption, and the control chips sends a first control signal and a second control signal according to the brightness signal and the first power consumption and outputs the same respectively through first control signal output end and the second control signal output end, and the voltage amplitude adjusting unit is electrically coupled to the first control signal output end, and reduces the amplitude of the first supply voltage under control of the first control signal, and the voltage duty ratio adjusting unit is electrically coupled to the second control signal output end, and increases the duty ratio of the first supply voltage under control of the second control signal.

14. The liquid crystal display device according to claim 13, wherein the voltage amplitude adjusting unit comprises a selector, a control register and a third resistor, and the first control signal output end comprises a first sub control signal output end, a second sub control signal output end, a third sub control signal output end and a fourth sub control signal output end, and the control chip is further employed to generate a resister control signal to be outputted through the fourth sub control signal output end, and the selector comprises a first select signal input end, a second select signal input end, a third select signal input end, a first signal end, a second signal end, a third signal end, a fourth signal, a fifth signal end, a sixth signal end, a seven signal end, an eighth signal end and a select signal output end, and wherein the first signal end to the eighth signal end are respectively supplied with various reference voltages, and the first select signal input end is electrically coupled to the first sub control signal output end, and the second select signal input end is electrically coupled to the second sub control signal output end, and the third select signal input end is electrically coupled to the third sub control signal output end, and the first select signal input end, the second select signal input end and the third select signal input end are employed to receive the first control signal, and the selector selects one reference voltage on the first signal end to the eighth signal end according to the first control signal, and outputs the same through the select signal output end, and the control register comprises a first end, a second end and a first output end, and the first end is electrically coupled to the fourth sub control signal output end to receive the register control signal, and the second end is electrically coupled to the select signal output end to receive the corresponding reference voltage, and the first output end is coupled to the third resistor and grounded, and a node between the first output end and the third resistor is employed to be an output end of the voltage amplitude adjusting unit, and the control register obtains a voltage amplitude adjusting signal according to the corresponding reference voltage and the register control signal, and outputs the same through the node between the first output end and the third resistor, and the voltage amplitude adjusting signal is employed to reduce the amplitude of the first supply voltage.

15. The liquid crystal display device according to claim 14, wherein as the first select signal input end, the second select signal input end and the third select signal input end sequentially receive the first control signal of 000, the selector selects the reference voltage of the first signal end and outputs the same through the select signal output end; as the first select signal input end, the second select signal input end and the third select signal input end sequentially receive the first control signal of 001, the selector selects the reference voltage of the second signal end and outputs the same through the select signal output end; as the first select signal input end, the second select signal input end and the third select signal input end sequentially receive the first control signal of 010, the selector selects the reference voltage of the third signal end and outputs the same through the select signal output end; as the first select signal input end, the second select signal input end and the third select signal input end sequentially receive the first control signal of 011, the selector selects the reference voltage of the fourth signal end and outputs the same through the select signal output end; as the first select signal input end, the second select signal input end and the third select signal input end sequentially receive the first control signal of 100, the selector selects the reference voltage of the fifth signal end and outputs the same through the select signal output end; as the first select signal input end, the second select signal input end and the third select signal input end sequentially receive the first control signal of 101, the selector selects the reference voltage of the sixth signal end and outputs the same through the select signal output end; as the first select signal input end, the second select signal input end and the third select signal input end sequentially receive the first control signal of 110, the selector selects the reference voltage of the seventh signal end and outputs the same through the select signal output end; as the first select signal input end, the second select signal input end and the third select signal input end sequentially receive the first control signal of 111, the selector selects the reference voltage of the eighth signal end and outputs the same through the select signal output end.

16. The liquid crystal display device according to claim 14, wherein the power regulating circuit further comprises a first thin film transistor, and the first thin film transistor comprises a first gate, a first source and a first drain, and an input end of the voltage duty ratio regulating unit is electrically coupled to the second control signal output end to receive the second control signal, and an output end of the voltage duty ratio regulating unit is electrically coupled to the first gate, and the first source is electrically coupled to a node between the first output end and the third resistor, and the first drain is electrically coupled to the light emitting unit.

17. The liquid crystal display device according to claim 10, wherein the light emitting unit is a light emitting diode.

18. The liquid crystal display device according to claim 10, wherein the brightness sensing unit is located adjacent to the light emitting unit.

* * * * *